US005285964A

United States Patent [19]

Vanotti

[11] Patent Number: 5,285,964

[45] Date of Patent: Feb. 15, 1994

[54] METHOD FOR CONSTRUCTING A RAILROAD IN CONCRETE HAVING VERTICAL AND LATERAL ADJUSTMENT STEPS PRIOR TO CONCRETE POURING

[75] Inventor: Gérard Vanotti, St-Paul-de-Varax, France

[73] Assignee: Etablissements Vape, St-Martin-du-Fresne, France

[21] Appl. No.: 61,311

[22] Filed: May 13, 1993

[30] Foreign Application Priority Data

May 22, 1992 [FR] France ..... 92 06303

[51] Int. Cl.[5] ..... E01B 21/00

[52] U.S. Cl. ..... 238/7; 238/9; 238/29; 238/377

[58] Field of Search ..... 238/2, 3, 4, 7, 8, 9, 238/29, 105, 265, 377; 104/2

[56] References Cited

U.S. PATENT DOCUMENTS

| | | | |
|---|---|---|---|
| 760,983 | 5/1904 | Gribble | 238/7 |
| 1,471,251 | 10/1923 | Falk | 238/265 X |
| 1,509,405 | 9/1924 | King | 238/265 X |
| 4,179,067 | 12/1979 | Baier | 238/377 X |
| 4,232,822 | 11/1980 | Hahn et al. | 238/7 |
| 4,947,756 | 8/1990 | Kusel et al. | 238/2 X |

FOREIGN PATENT DOCUMENTS

| | | |
|---|---|---|
| 903871 | 4/1986 | Belgium . |
| 554240 | 6/1932 | Fed. Rep. of Germany . |
| 3443953 | 12/1986 | Fed. Rep. of Germany . |
| 3539225 | 5/1987 | Fed. Rep. of Germany . |
| 443607 | 9/1912 | France . |
| 2657096 | 7/1991 | France . |

*Primary Examiner*—Robert J. Oberleitner
*Assistant Examiner*—S. Joseph Morano
*Attorney, Agent, or Firm*—Kane, Dalsimer, Sullivan, Kurucz, Levy, Eisele & Richard

[57] ABSTRACT

The method relates to the laying of rails in a trench into which concrete is subsequently poured in order to fasten the rails. The method consists in laying adjustable-length ties (4) on the bottom of the trench (3), in roughly positioning the rails (14, 15) by means of block-supports, in fastening the ties to the rails by using tie-screws (10) and anchor sleeves (11) as bolts and nuts, in adjusting the length of the ties and in leveling the ties by means of auxiliary screws (18), and then in pouring the concrete, the auxiliary screws being subsequently removed. The ties are preferably pre-equipped with tie-screws, with sleeves and with rail-fastening clamps and the tie-screws and the sleeves may also be used for fastening tie-plates to the ties.

3 Claims, 4 Drawing Sheets

METHOD FOR CONSTRUCTING A RAILROAD IN CONCRETE HAVING VERTICAL AND LATERAL ADJUSTMENT STEPS PRIOR TO CONCRETE POURING

FIELD OF THE INVENTION

The present invention relates to a method for constructing a railroad in which rails are positioned in a trench into which concrete is subsequently poured in order to fasten the rails.

PRIOR ART

For laying rails in roads, especially grooved rails for tramways, it has been known for a long time to fasten the rails by embedding them in concrete covered with a layer of asphalt. For this purpose, the rails are laid on block-supports by means of which they are leveled as accurately as possible. The distance between the rails is provided by provisional auxiliary means and they are fastened onto timber or concrete ties or blocks.

Such a rail-positioning method is lengthy, tricky and tedious.

SUMMARY OF THE INVENTION

The present invention aims to simplify and to rationalize rail positioning.

The construction method according to the invention is one in which ties are made having means for adjusting their length predisposing the track gage, these ties are laid down on the bottom of the trench in a position corresponding approximately to the desired tie-spacing, the rails are laid on provisional block-supports and a rough vertical and horizontal positioning of the rails is carried out by means of these block-supports, the ties are lifted up and are fastened to the rails by using tie-screws and anchor sleeves respectively as bolts and nuts for holding the rail-fastening parts, vertical leveling screws are screwed into the tie and bearing plates for the end of said screws are disposed under the screws, on the bottom of the trench, the rails are leveled by means of leveling screws, the gage-setting of the track is adjusted by the tie-length adjustment means, the concrete is poured into the trench so as to cover the ties, and the leveling screws are removed.

The novelty of the invention resides, on the one hand, in the use of anchor sleeves first of all as nuts for fastening the ties to the rails with the sleeves then forming an integral part of the tie, and then as conventional anchoring means and, on the other hand, in the use of leveling screws permitting rapid, reliable and accurate leveling. These leveling screws are not lost, but are reused. The anchor sleeves are preferably constituted by PLASTIRAIL (registered trademark) sleeves.

The ties may be preequipped with tie-screws and anchor sleeves, the sleeves being used as nuts for the retention of the tie-screws on the ties.

The rails may be fastened by any known fastener, preferably clamps such as described in the Patent FR 2.661.697.

BRIEF DESCRIPTION OF THE DRAWINGS

An example implementing the method according to the invention will be described hereinbelow with reference to the attached drawing, in which.

DESCRIPTION OF THE PREFERRED EMBODIMENT(S)

A description will be given of a track repair, but this could just as well refer to the first laying of a track.

After having removed the existing track from the road 1, a trench 2 intended to constitute a new bed is dug for the new track to be laid. If necessary, a floor 3 is laid.

Figure 1:
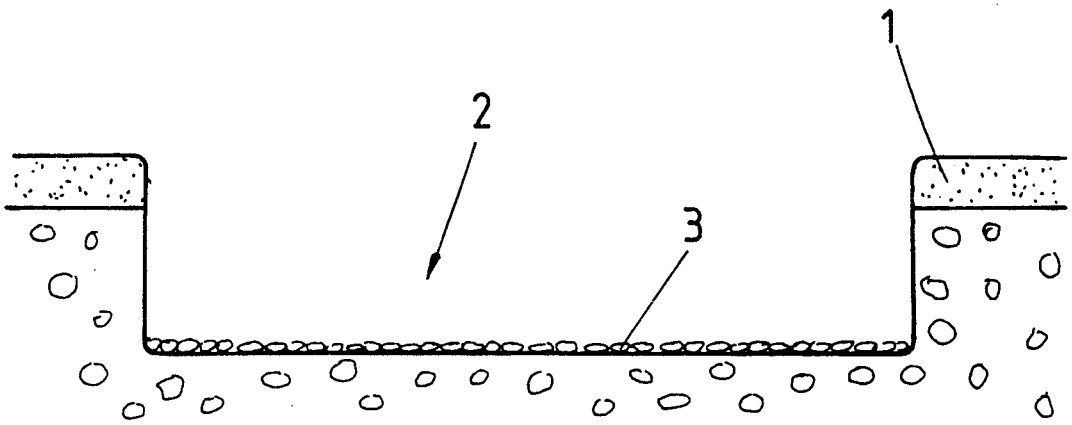
FIG. 1 is a cross section of the trench.
Figure 2:
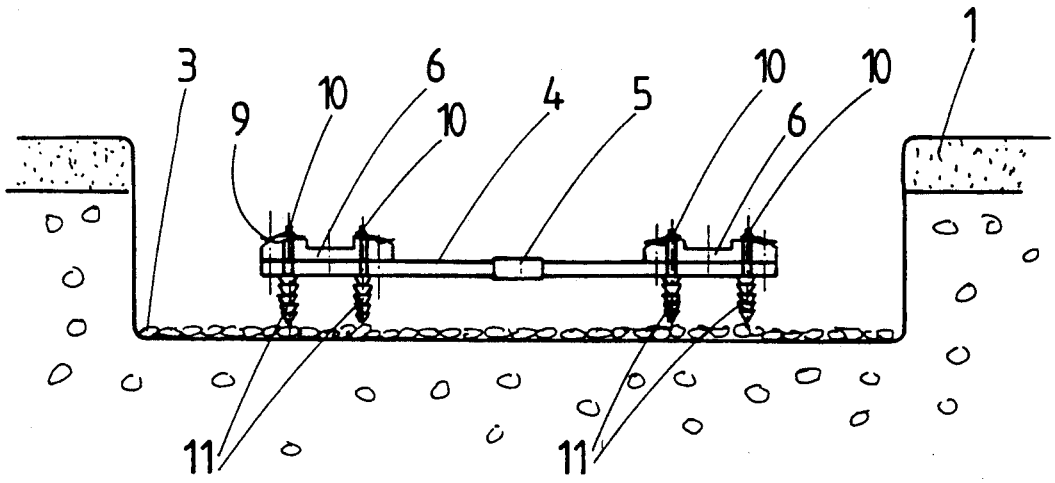
FIG. 2 represents a tie laid on the bottom of the trench.
Figure 5:
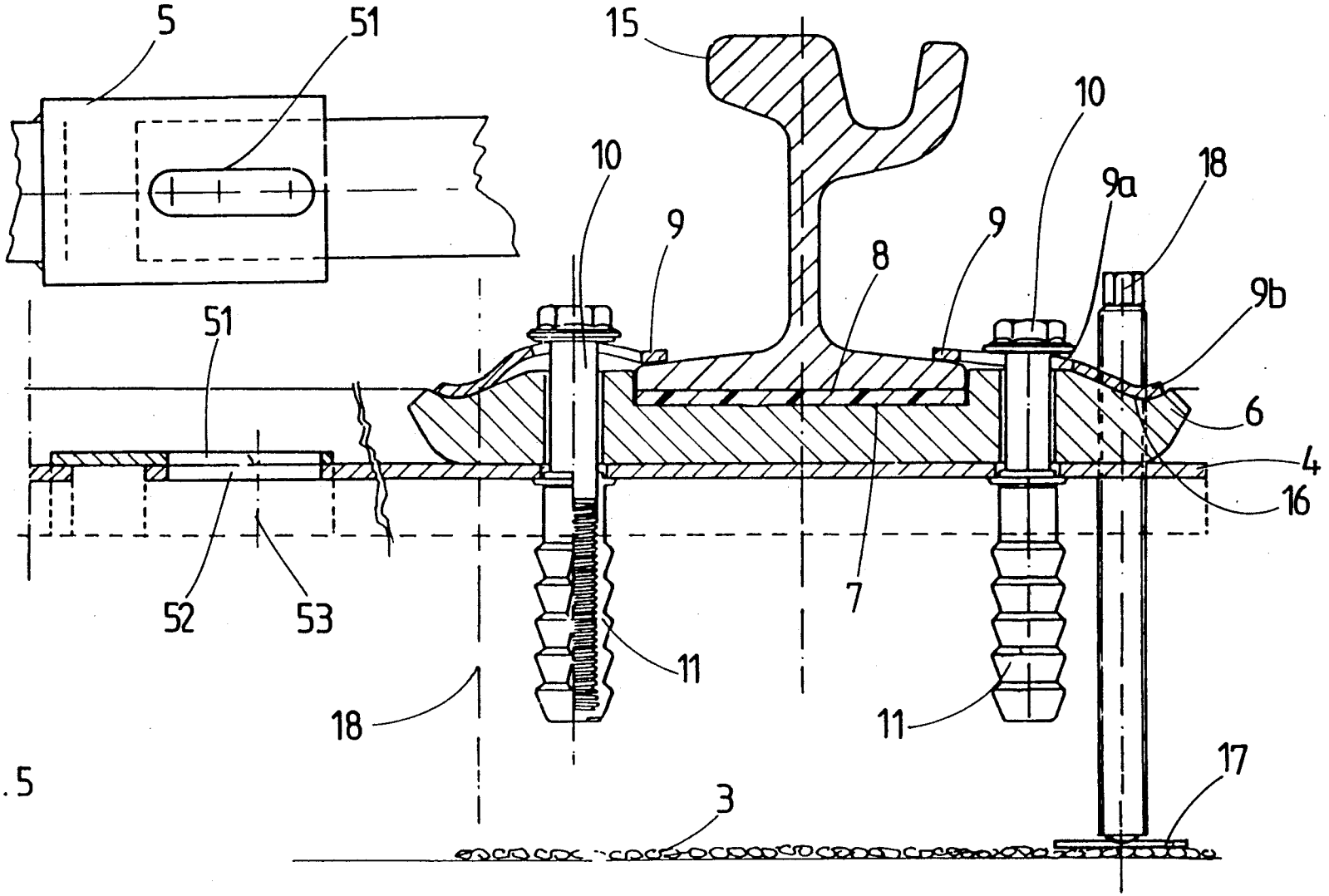
FIG. 5 is a detailed view of FIG. 4.

Next, as represented in FIG. 2, ties 4 equipped with anchoring means and with rail-fastening means are laid down on the .floor 3 with the approximate tie-spacing. This tie is represented in more detail in FIG. 5. It is made of two U-shaped profiled portions joined together by a part 5 enabling the length of the tie to be altered. The part 5 is simply a U-shaped part welded to one of the portions of the tie and in which the other portion of the tie is engaged. It has an elongate hole 51 located opposite an elongate hole 52 of the tie for a bolt 53 to pass through and for the length of the tie to be adjusted. The tie, preferably constituted by a U-shaped section, is fitted with two metal tie-plates 6 welded to the tie. Each of these tie-plates 6 has, in a known manner, a housing 7 for the rail, in which housing a resilient tie-pad 8 is housed. The tie-plates 6 are pre-equipped with rail-fastening clamps 9, clamps similar to those described in the Patent FR 2,661,697. These clamps are constituted by convex plates provided with an elongate hole **9*a* and with a rounded heel 9*b*. The clamps 9 are held, on the pre-equipped tie, in a preparatory position by a tie-screw and a PLASTIRAIL (registered trademark) anchor sleeve 11 used here as nut with the tie-screw 10 in order to hold the clamp 9 in place. In this preparatory position, the heel 9*b* of the clamps 9** bears in a slight depression in the tie-plate.

The tie-screws 10 and the sleeves 11 could also serve for fastening the tie-plates 6 to the tie.

Figure 3:
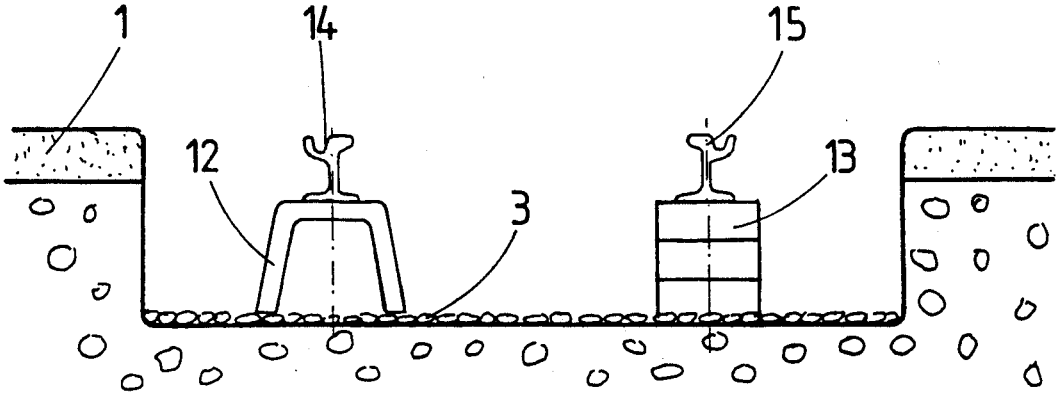
FIG. 3 represents the rough leveling of the rails.

Next, block-supports such as 12 and 13 (FIG. 3), on which the rails 14 and 15 are laid at a distance apart corresponding very approximately to the desired gage-setting, are disposed on the floor 3 between the ties. The block-supports 12 and 13 provide for a rough leveling of the rails 14 and 15.

Figure 4:
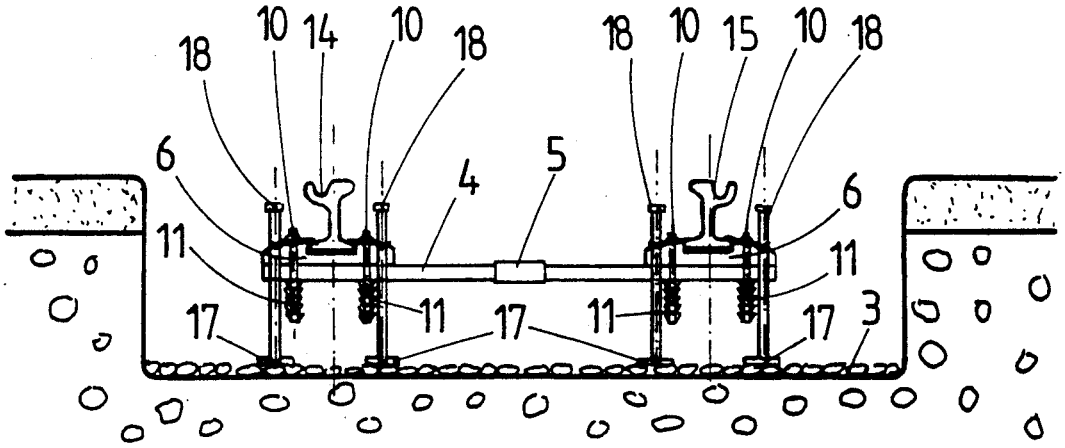
FIG. 4 shows the accurate positioning of the rails.

Next, the ties 4 are lifted up, bringing the rails into the housings 7 of the tie-plates 6 and the ties are fastened to the rails by pushing the clamps 9 towards the rail, in such a manner that they come onto the rail foot, their heel **9*b* being housed in a hollow 16 of the tie-plates, as described in the Patent FR 2,661,697. Next, the clamps 9 are tightened by means of the tie-screws 10 by once again using the anchor sleeves 11 as nuts. This position is represented in the left-hand portion of FIG. 5. Next, metal or plastic plates 17 are disposed on the floor 3 under the ties. Next (FIGS. 4 and 5), vertical leveling screws 18, the ends of which bear on the plates 17**, are screwed into the tie-plates in tapped holes provided for this purpose.

Next, accurate adjustment of the gage-setting is carried out by means of the linkage part 5 of the tie and accurate leveling of the rails is carried out by means of the leveling screws 18.

Figure 6:
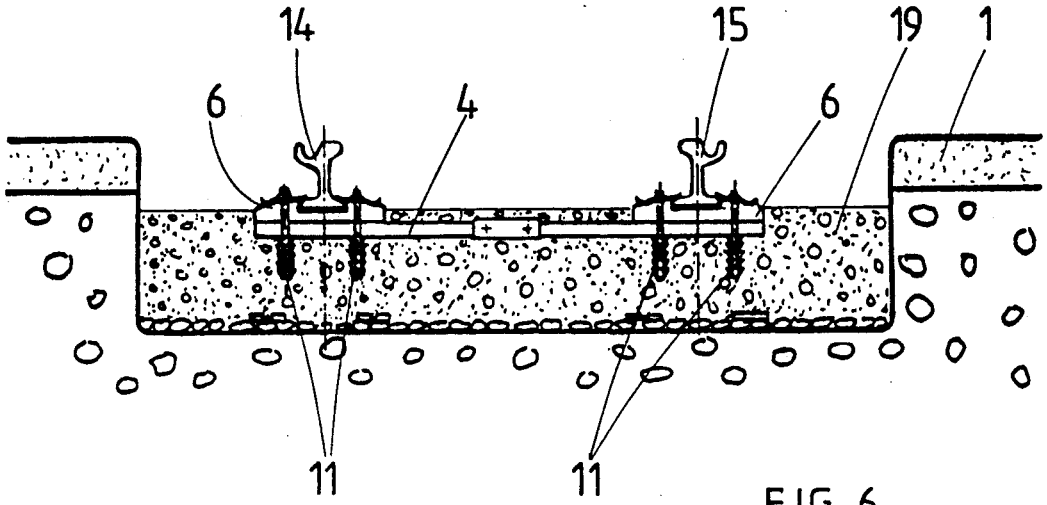
FIG. 6 represents the trench after pouring the concrete.

Next, concrete 19 is poured into the trench up to the level of the tie-plates 6, without covering the clamps 9 and the heads of the tie-screws 10. Next (FIG. 6), the leveling screws 18 are withdrawn and can then be re-used.

The anchor sleeves 11 are used here in their first function, that is to say in their function of anchoring in the concrete 19.

Figure 7:
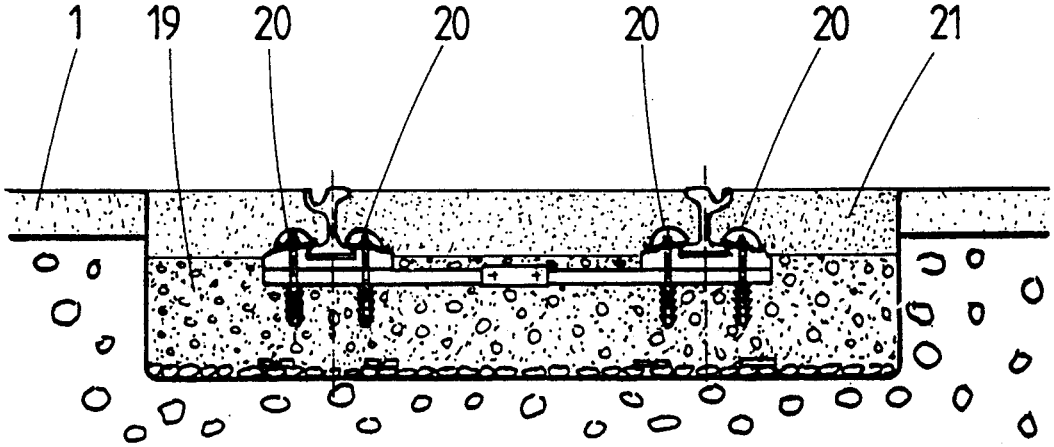
FIG. 7 represents the same trench after laying the asphalt.

Next (FIG. 7), protective covers 20 are disposed on the clamps 9 and then the asphalt 21 is laid up to the level of the road The covers 20 enable, during the track repair, the clamps 9 to be moved aside and, consequently, the worn rails to be removed.

The method described hereinabove is capable of several variants.

The anchoring and rail-fastening means could be fitted in situ onto the ties. The leveling screws could be fitted onto the ties before laying them on the floor, in such a way that the ties could rest on the leveling screws instead of resting on the anchor sleeves. The leveling screws could be installed on the ties before the anchoring and rail-fastening means.

The ties could be manufactured from non-metallic material, especially from synthetic or inorganic material. The clamps 9 could be replaced by any suitable type of fastener. These fasteners could pre-equip the ties or be fitted in situ. In the latter case, the tie could be pre-equipped only with tie-screws and with anchor sleeves, the anchor sleeves being used as nuts for the retention of the tie-screws on the ties.

The metal or plastic tie-plates could be fastened to the tie by means of the rail-fastening devices.

The method can be used with any type of road surfacing, such as paving blocks, turfing, etc.

I claim:

1. A method for constructing a railroad, according in which rails are positioned in a trench into which concrete is subsequently poured in order to fasten the rails, wherein:

ties are made having means for adjusting their length, these ties are laid down on the bottom of the trench in a position corresponding approximately to the desired tie-spacing, the rails are laid on provisional block-supports and a rough vertical and horizontal positioning of the rails is carried out by means of these block-supports, the ties are lifted up and are fastened to the rails by using tie-screws and anchor sleeves respectively as bolts and nuts for holding rail-fastening parts, vertical leveling screws are screwed into the tie and bearing plates for the end of said screws are disposed under the screws, on the bottom of the trench, the rails are leveled by means of the leveling screws, gage-setting of the track is adjusted by the tie-length adjustment means, the concrete is poured into the trench so as to cover the ties, and the leveling screws are removed.

2. The method as claimed in claim 1, wherein the ties are pre-equipped with the tie-screws and with the anchor sleeves, as well as with the rail-fastening fasteners.

3. The method as claimed in claim 2, wherein ties provided with one of metal and plastic tie-plates are used, wherein the concrete is poured up to the height of the tie-plates, but without covering the fasteners, wherein protective covers are disposed on the fasteners and wherein a surfacing is laid up to the height of the rail head.

* * * * *